United States Patent [19]

Greenlees

[11] 3,952,662

[45] Apr. 27, 1976

[54] NON-LETHAL PROJECTILE FOR RIOT CONTROL

[76] Inventor: William D. Greenlees, Rte. No. 1, Box 711-L, Accokeek, Md. 20607

[22] Filed: May 29, 1974

[21] Appl. No.: 474,472

[52] U.S. Cl. ..... 102/92.7; 102/92.1; 102/92.6

[51] Int. Cl.[2] ..... F42B 11/02

[58] Field of Search ..... 102/92.7, 92.6, 92.1, 102/92, 42

[56] References Cited

UNITED STATES PATENTS

| | | | |
|---|---|---|---|
| 3,528,662 | 9/1970 | Merchant et al. | 102/92.7 |
| 3,650,213 | 3/1972 | Abbott et al. | 102/92.7 |
| 3,762,329 | 10/1973 | Mawhinney | 102/92.7 |
| 3,776,137 | 12/1973 | Abbott | 102/92.7 |
| 3,834,311 | 9/1974 | Mawhinney et al. | 102/92.7 |
| 3,865,038 | 2/1975 | Barr | 102/92.7 |

*Primary Examiner*—Charles T. Jordan

*Attorney, Agent, or Firm*—R. Sciascia; R. Beers; S. Scheinbein

[57] ABSTRACT

A flexible, non-lethal projectile adapted to be fired from a conventional shotgun comprising a pliant body having a plurality of flexible arms. The projectile may be loaded in a shotgun shell casing and fixed therefrom. Upon exit from the gun muzzle the projectile arms extend and provide a large impact area to prevent penetration of the projectile into a target.

8 Claims, 6 Drawing Figures

NON-LETHAL PROJECTILE FOR RIOT CONTROL

STATEMENT OF GOVERNMENT INTEREST

The invention described herein may be manufactured and used by or for the Government of the United States of America for governmental purposes without the payment of any royalities thereon or therefor.

BACKGROUND OF THE INVENTION

The present invention relates in general to non-lethal ammunition and more particularly to ammunition for riot control.

Both public and private organizations are expending much effort and expense in developing methods and procedures which will effectively and safely control a large group of people. The need for such methods is important in a situation where judgmental errors by those trying to control a disorderly assemblage of persons could result in fatalities The equipment used to control tense mob situations must be effective to protect bystanders and the authorities; yet should not be lethal. Desirable features of such equipment are therefore effectiveness as well as economy. One example of riot control equipment is the launcher and projectile shown in Jones, et al. U.S. Pat. No. 3,733,727.

The riot control equipment, of which Jones is an example, requires special launchers. The expense of adding special equipment to the already expensive arsenal possessed by most law enforcement agencies may be prohibitive. Further, an important psychological advantage to the authorities may be lost where a mob observes the use of non-lethal launchers. This advantage results from the momentary doubt on the part of the potential rioters as to whether the authorities are using non-lethal or lethal ammunition. Thus, absent any hesitation, the tense and explosive situation may quickly develop into a full riot, whereas a momentary hesitation might be enough to allow the authorities to establish control and quell the riot in its inception.

The present invention overcomes these disadvantages by providng non-lethal ammunition which can be used with the conventional shotguns already possessed by most law enforcement authorities. The economies are obvious and the momentary hesitation caused by the presence of actual shotguns serves the purpose of giving the authorities a little extra time to establish control.

SUMMARY OF THE INVENTION

Briefly, the present invention is a non-lethal projectile adapted to be fired from a smooth-bore gun such as a conventional shotgun. The projectile comprises a pliant body having a plurality of flexible arms. The projectile is loaded into a conventional shotgun shell casing. The projectile is positioned in the shell casing with the arms extending rearward from the exit end of the casing.

A large surface area is presented for impact. The possibility of scoring a hit is increased while the possibility of penetration is reduced.

An alternative embodiment of the projectile has a hollow pliant body which is inflated by the expanding shotgun gases by means of a valve in the body.

OBJECTS OF THE INVENTION

It is therefore a broad objective of the present invention to improve the effectiveness of riot control methods and equipment.

Another object is to improve the versatility of riot control ammunition.

Another object is to provide non-lethal projectiles which can be fired from a conventional shotgun and which can be inexpensively and simply manufactured and loaded into shell casings.

Other objects, features and advantages as well as a fuller understanding of the invention may be had by referring to the following description and claims, taken in conjunction with the accompanying drawings, in which:

Throughout the figures of the drawing, the same parts are represented by the same reference numerals while equvalent parts are given prime designations.

BRIEF DESCRIPTION OF THE PREFERRED EMBODIMENT

Figure 1:
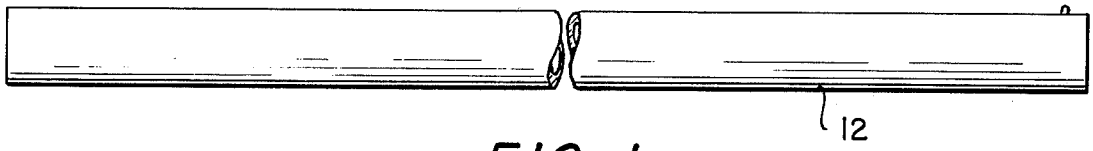
FIG. 1 shows the barrel of a shotgun in which the invention can be used.

With reference to the drawings, the invention is illustrated as being utilized in a conventional breach-loading shotgun having a straight barrel 12 (only the barrel is shown).

A non-lethal projectile 26 is encased in a shell casing 14 having walls 16 with crimping at ends 18 and a conventional back having a detonator cap 24 at end 19. A powder charge 20 is positioned adjacent end 19 and is separated from projectile 26 by wadding 22.

Preferably, the size and other dimensions of shell casing 14 may, for example, be approximately that of a 12 gage shotgun shell. This facilitates easy and rapid change over from the non-lethal ammunition to live ammunition in a situation requiring live ammunition. The use of a conventional shotgun also places the seeds of doubt in the minds of any potential rioters as to whether authorities are using non-lethal or lethal ammunition. The psychological effect may be sufficient to allow a riot to be quelled without resorting to any more than the mere threat of live ammunition. Casing 14 can be manufactured in a variety of sizes to fit any size gun which might be used by authorities.

Figure 2:
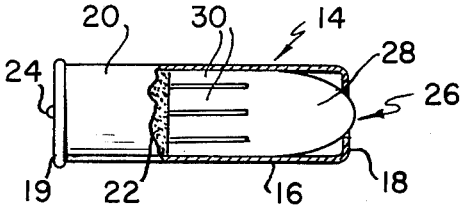
FIG. 2 shows a cut-a-way side view of the non-lethal projectile loaded in a shotgun shell casing.
Figure 3:
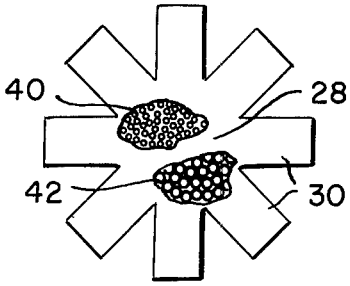
FIG. 3 shows a front view of the projectile in expanded position with cut-a-way portions.
Figure 4:
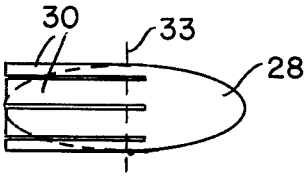
FIG. 4 shows a side view of the projectile.

As is best shown in FIGS. 2 through 4, projectile 26 has an essentially spherical pliant central body 28 having a plurality of flexible arms 30 integral therewith. The arms can be finger-like in shape. Arms 30 are preferably manufactured from the same material as body 28, but can be other suitable material Preferably, the body 28 and arms 30 of the projectile are all one piece such as may be formed in a single molding process. However, the body and arms may be formed separately and later attached to points such as 32. The projectile is deformable and therefore could be fabricated out of an elastomer such as rubber in any well known molding procedure. The material is selected according to the amount of deformation desired both pre- and post-impact. Since the projectile will preferably be used in a conventional shotgun, material selection for projectile 26 will be influenced by size and power of powder charge 20 as well as the anticipated range of the weapon. The range is selected according to desired accuracy and impact force. The impact force is chosen according to that force required to simply stun as opposed to that force required to penetrate into the expected target.

A large and powerful charge 20 will require a more resilient material for projectile 26 and vice versa. The stresses placed on the projectile as it travels through muzzle 12 are also a function of the powder charge 20.

As shown, body 28 has leading and trailing sections separated by midplane 33 when the projectile is positioned in shell casing 14. Arms 30 are positioned on the body in the rear section. The distance between arms and midplane 33 is determined according to the desired range, impact and stability of the projectile. The center of gravity for body 28 is located in midplane 33. The position of the center of gravity, of course, influences the flight of the projectile. The position of arms 30 forward of the midplane provides flight stability to the projectile as there is thus provided more weight in the leading end of the projectile.

The arm 30 are preferably, but need not be, positioned symetrically about the periphery of body 28. The arms can be of several dimensions, as dictated by the desired overall size, and, impact force, as well as the desired positioned of the center of gravity. The size of the arms determine the size of the impact area of the projectile. The arms also dictate the shape of the projectile. The shape of the projectile is preferably that shown, but may be any other desired configuration.

The projectiles can be produced in a variety of shapes and sizes and then loaded into shell casing 14 immedietely prior to use. Thus, a large variety of projectiles can be stored and only used as the situation demands. This reduces expenses and allows a few standard shell casings to be used for a large variety of situations.

Figure 5:
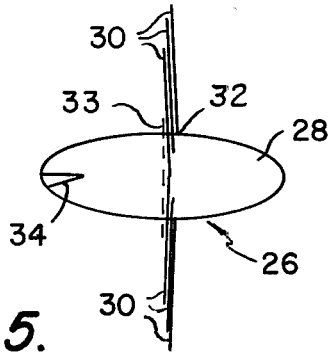
FIG. 5 shows a side view of an alternative embodiment of the projectile.

A second embodiment of the projectile is shown in FIG. 5. The projectile 26 having a pliant body 28 and a plurality of arms 30 has a midplane 33. The body 26 is hollow and is inflated by means of valve 34. When inflated, the body is essentially the same oval shape as that of the preferred embodiment shown in FIG. 4. Arms 30 are positioned along the rear section of body 28.

The valve is positioned in body 28 such that it is in the trailing section when the body is positioned in shell casing 14. Expanding gases from powder charge 20 force valve 34 to open and thus inflate the projectile body. When pressure inside body 26 is equal to or greater than that outside of the body, valve 34 is forced closed.

As with the preferred embodiment, the projectile of the second embodiment can be fabricated in a single process molding procedure. The wall thickness of body 26 is influenced by the desired internal pressure for the projectile. The thickness must be sufficient to withstand the expected internal pressure, but must be flexible enough to prevent penetration of the target by the projectile upon impact.

Further considerations which influence the wall thickness of body 26 are: size and accuracy of the projectile; amount of bypass gas desired; and range considerations.

Wall strength is also influenced by impact force and valve size.

The valve 34 may be similar to those valves used to inflate beach balls, and should be selected to allow complete, inflation of body 26 prior to the exit of the projectile from the gun muzzle.

Alternative embodiments could employ ballast such as shot or weights inside of the body in lieu of the gas filled or the solid configurations. The shot could be conventional buckshot or plastic crushable shot. The cut-a-way portion of FIG. 3 shows buckshot 40 and weights 42. Obviously, proper placement and/or distribution of either will affect the flight, range and accuracy of the projectile. It should be understood that the force of the powder charge in the shell should not be of such magnitude as to tear or rip the body 28 and release the buckshot from the interior of the body 28.

Figure 6:
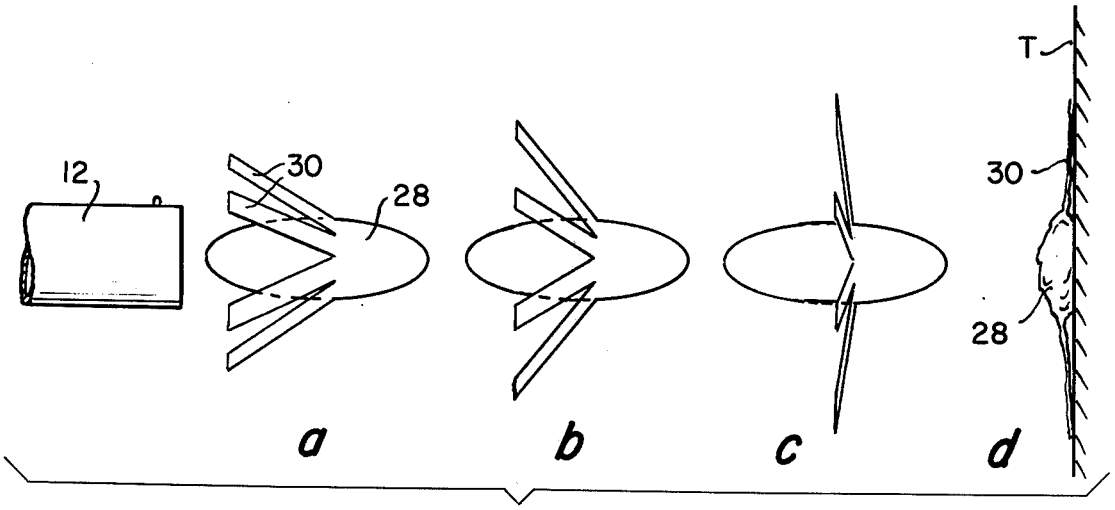
FIG. 6 shows the operation of the projectile embodied in the present invention.

The positions of the projectile during flight are shown in FIG. 6. The projectile is fired directly at a target T. When the projectile exits from muzzle 12 it is in a slightly compacted shape as shown at station *a* with the arms folded and trailing the body. Upon exit from the gun muzzle, the arms unfold and the projectile assumes the shape shown at station *b.* The configurations shown at station *c* is determined by the length and size of the arms. Upon impact, the leading end of the body strikes the target first and, being flexible, flattens somewhat on impact. This slightly reduces the impact force. The arms 30 swing forward and strike the target at a time slightly later than the main body 28 thereby further absorbing the impact and spreading it out over a large area in order to prevent penetration into T. The arms and/or body may contain a fluid which can be used to mark or sting the target or bind the projectile to the target. As seen, even if the body misses the target, the arms have a good chance of striking it. Thus the probability of a "hit" is increased.

Once the projectile exits from the muzzle, the operation of the second embodiment is similar to that of the preferred embodiment, the filling operation occuring during the time the projectile is inside of the muzzle.

Obviously, many modifications and variations of the present invention are possible in light of the above teachings. It is therefore to be understood that, within the scope of the appended claims, the invention may be practiced otherwise than as specifically described.

What is claimed is:

1. A non-lethal projectile adapted to be fired from a gun barrel comprising:

a central, pliant, deformable, non-rupturable body having a plurality of flexible finger-like arms integral therewith and extending rearwardly, each of said arms being affixed to said body only at the end which is nearer the front of said body for extension transversely to said body after firing of said projectile, said body flattening out upon impacting an object, so that impact force of said projectile is reduced, said arms swinging forward to strike said object at a time slightly later than said body, thereby further absorbing said impact and spreading said impact over a large area whereby said projectile does not penetrate said object.

2. The projectile of claim 1 wherein said arms are connected at only one end to said body adjacent the periphery thereof and are substantially equally spaced from one another and symetrically arranged on said body, said body comprising roller

3. A non-lethal projectile adapted to be fired from a gun barrel comprising:

a central, pliant, hollow, non-rupturable body having a plurality of spaced, flexible, finger-like arms integral therewith and extending rearwardly, each of said arms being affixed to said body only at the end which is nearer the front of said body for extension transversely to said body after firing of said projectile, said body including a valve positioned on said body for enabling fluid to enter said body, said body flattening out upon impacting an object.

4. The non-lethal projectile of claim 3 wherein said pliant body and arms are molded.

5. The non-lethal projectile of claim 3 wherein said arms are separately molded from the main portion of said body.

6. A non-lethal projectile adapted to be fired from a gun barrel comprising:

a central, pliant, non-rupturable body having a plurality of spaced flexible finger-line arms integral therewith and extending rearwardly, each of said arms being affixed to said body only at the end which is nearer the front of said body for extension transversely to said body after firing of said projectile, said body flattening out upon impacting an object; and wherein said projectile contains a fluid.

7. A non-lethal projectile adapted to be fired from a gun barrel comprising:

a central, pliant, non-rupturable body having a plurality of spaced flexible finger-like arms integral therewith and extending rearwardly, each of said arms being affixed to said body only at the end which is nearer the front of said body for extension transversely to said body after firing of said projectile, said body flattening out upon impacting an object; and wherein said projectile contains ballast.

8. A non-lethal projectile adapted to be fired from a gun barrel comprising:

a central, pliant, non-rupturable body having a plurality of spaced, flexible, finger-like arms integral therewith and extending rearwardly, each of said arms being affixed to said body only at the end which is nearer the front of said body for extension transversely to said body after firing of said projectile, the point at which each arm is affixed to said body being near the midplane of said body, said body flattening out upon impacting an object.

* * * * *